US006271472B1

(12) United States Patent
Mattos et al.

(10) Patent No.: US 6,271,472 B1
(45) Date of Patent: Aug. 7, 2001

(54) ULTRA THIN AND FLEXIBLE SCSI CABLE AND METHOD FOR MAKING SAME

(75) Inventors: Steve D. Mattos, Livermore, CA (US); David E. Karrmann, Washington, NH (US); Kenneth J. Plourde, Upton, MA (US)

(73) Assignee: Adaptec, Inc., Milpitas, CA (US)

( * ) Notice: Subject to any disclaimer, the term of this patent is extended or adjusted under 35 U.S.C. 154(b) by 0 days.

(21) Appl. No.: 09/557,692

(22) Filed: Apr. 25, 2000

Related U.S. Application Data

(63) Continuation of application No. 09/299,688, filed on Apr. 26, 1999, now Pat. No. 6,124,551.
(60) Provisional application No. 60/129,455, filed on Apr. 15, 1999.

(51) Int. Cl.[7] ..... H01B 11/02
(52) U.S. Cl. ..... 174/113 R; 174/36
(58) Field of Search ..... 174/27, 36, 113 R, 174/106 R, 113 C, 131 A, 108

(56) References Cited

U.S. PATENT DOCUMENTS

| | | | | |
|---|---|---|---|---|
| 3,031,524 | * | 4/1962 | Hicks | 174/112 |
| 3,489,844 | * | 1/1970 | Motley | 174/27 X |
| 3,588,317 | * | 6/1971 | Hutchins, Jr. | 174/108 |
| 3,678,177 | * | 7/1972 | Lawrenson | 174/113 C |
| 4,538,022 | * | 8/1985 | Ottler et al. | 174/113 R |
| 4,604,497 | * | 8/1986 | Bell et al. | 174/36 X |
| 5,434,354 | * | 7/1995 | Baker et al. | 174/36 |
| 5,486,649 | * | 1/1996 | Gareis | 174/36 |
| 5,493,071 | * | 2/1996 | Newmoyer | 174/113 R |
| 5,519,173 | * | 5/1996 | Newmoyer et al. | 174/113 R |
| 5,544,270 | * | 8/1996 | Clark et al. | 174/27 |
| 5,834,699 | * | 11/1998 | Buck et al. | 174/113 R |

* cited by examiner

*Primary Examiner*—Chau N. Nguyen
(74) *Attorney, Agent, or Firm*—Martine & Penilla, LLP

(57) ABSTRACT

A SCSI external cable for interconnecting external peripheral devices to a host computer system or other peripheral devices is provided. The SCSI cable is configured to be ultra-thin and flexible and is designed to handle high bandwidths and support longer cabling distances, relative to conventional SCSI cabling. The SCSI cable includes: (a) an inner non-conducting fiber; (b) a first layer of twisted pairs, each of the first layer twisted pairs being concentrically wrapped around the inner non-conducting fiber; (c) a second layer of twisted pairs, each of the second layer twisted pairs being concentrically wrapped around the first layer of twisted pairs; (d) an inner shield being concentrically wrapped in a first direction around the second layer of twisted pairs, the inner shield being in the form of a tape strip; (e) an outer shield being concentrically wrapped in a second direction around the inner shield, the second direction being opposite the first direction of the inner shield, and the outer shield is in the form of a plurality of flat copper filaments, the plurality of flat copper filaments provide the SCS external cable an increased degree of flexibility; and (f) a jacket configured to wrap around the outer shield. In one example, a separator can be wrapped around the second layer of twisted pairs, and before the inner shield, to assist in meeting the SCSI electrical requirements. In another example where the separator is not used, it is preferred that each wire in the first layer and the second layer has a respective first layer insulation and a second layer insulation, and the second layer insulation is configured to be thicker than the first layer insulation.

27 Claims, 7 Drawing Sheets

| Differential | | Single End | | |
|---|---|---|---|---|
| $Z_0$(ohms) | C(pF/ft) | $Z_0$(ohms) | C(pF/ft) | $t_p$(ns/ft) |
| **CORE LAYER** | | | | |
| 146.0 | 10.3 | 93.2 | 16.0 | 1.498 |
| 146.0 | 10.2 | 92.4 | 16.1 | 1.490 |
| 147.5 | 10.2 | 93.0 | 16.1 | 1.500 |
| 147.2 | 10.1 | 92.8 | 16.1 | 1.494 |
| 147.2 | 10.1 | 93.4 | 16.0 | 1.494 |
| 148.4 | 10.1 | 93.4 | 16.0 | 1.497 |

FIG. 5A

| Differential | | Single End | | |
|---|---|---|---|---|
| $Z_0$(ohms) | C(pF/ft) | $Z_0$(ohms) | C(pF/ft) | $t_p$(ns/ft) |
| **1st LAYER** | | | | |
| 144.8 | 10.4 | 93.1 | 16.2 | 1.507 |
| 148.4 | 10.1 | 92.5 | 16.2 | 1.504 |
| 146.2 | 10.3 | 93.8 | 16.1 | 1.508 |
| 145.7 | 10.3 | 95.0 | 15.8 | 1.506 |
| 145.7 | 10.3 | 93.4 | 16.1 | 1.502 |
| 144.5 | 10.4 | 94.2 | 16.0 | 1.504 |
| 146.9 | 10.2 | 94.3 | 15.9 | 1.502 |
| 144.5 | 10.4 | 94.0 | 16.0 | 1.507 |
| 145.7 | 10.3 | 93.5 | 16.0 | 1.501 |
| 144.5 | 10.4 | 94.8 | 15.9 | 1.507 |
| 146.9 | 10.2 | 94.0 | 16.0 | 1.502 |
| 145.7 | 10.3 | 93.6 | 16.1 | 1.509 |

FIG. 5B

| Differential | | Single End | | |
|---|---|---|---|---|
| $Z_0$ (ohms) | C(pF/ft) | $Z_0$ (ohms) | C(pF/ft) | $t_p$ (ns/ft) |
| **2nd LAYER** | | | | |
| 148.1 | 10.2 | 88.6 | 17.1 | 1.515 |
| 149.4 | 10.0 | 87.1 | 17.2 | 1.499 |
| 148.1 | 10.2 | 88.8 | 16.9 | 1.505 |
| 146.9 | 10.2 | 88.9 | 16.9 | 1.505 |
| 148.1 | 10.0 | 88.0 | 16.7 | 1.486 |
| 146.9 | 10.0 | 88.0 | 16.7 | 1.473 |
| 148.1 | 10.1 | 88.0 | 17.0 | 1.500 |
| 148.1 | 10.2 | 87.0 | 17.4 | 1.517 |
| 146.9 | 10.2 | 87.5 | 17.1 | 1.500 |
| 148.1 | 10.1 | 88.4 | 16.9 | 1.500 |
| 146.9 | 10.2 | 88.0 | 17.0 | 1.500 |
| 146.9 | 10.1 | 89.0 | 16.7 | 1.492 |
| 148.1 | 10.0 | 87.6 | 17.0 | 1.490 |
| 148.1 | 10.1 | 87.3 | 17.2 | 1.500 |
| 148.1 | 10.1 | 88.4 | 16.9 | 1.495 |
| 147.4 | 10.2 | 88.0 | 17.0 | 1.500 |

FIG. 5C

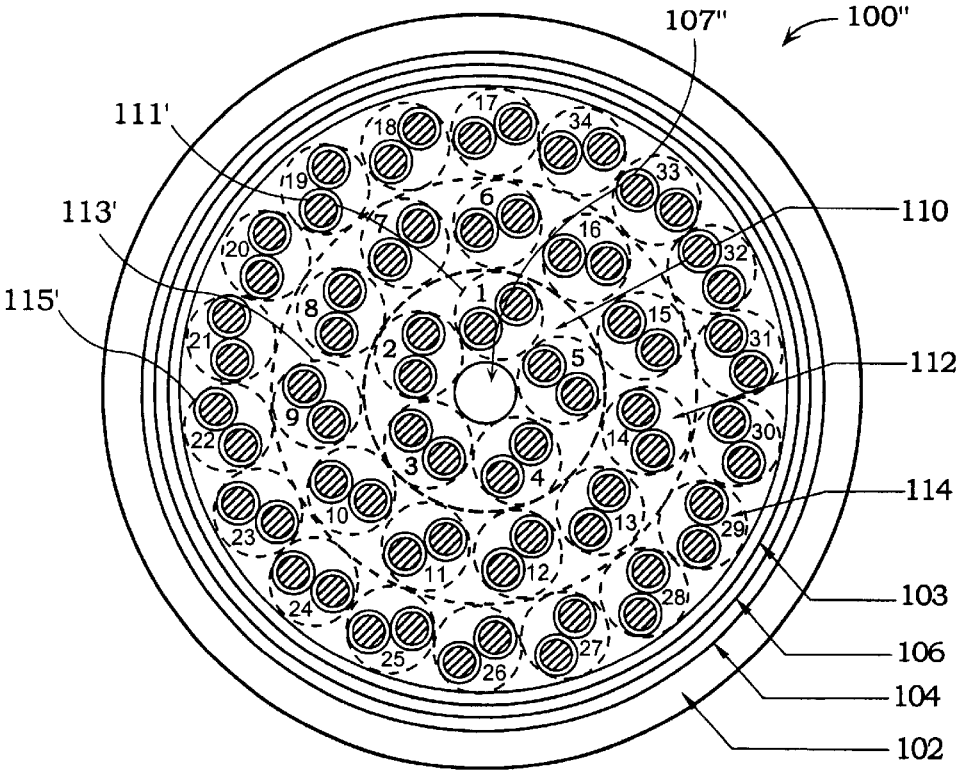

FIG. 6

| PAIR No. | PAIR COLOR CODE |
|---|---|
| | CORE LAYER |
| 1 | Green/Red |
| 2 | Green/Orange |
| 3 | Green/Yellow |
| 4 | Green/Blue |
| 5 | Green/Black |
| | 2nd LAYER |
| 6 | Gray/Brown |
| 7 | Gray/Red |
| 8 | Gray/Orange |
| 9 | Gray/Yellow |
| 10 | Gray/Green |
| 11 | Gray/Blue |
| 12 | Gray/Black |
| 13 | Red/Orange |
| 14 | Red/Yellow |
| 15 | Red/Black |
| 16 | Orange/Black |

| PAIR No. | PAIR COLOR CODE |
|---|---|
| | 3rd LAYER |
| 17 | Brown/Red |
| 18 | Brown/Orange |
| 19 | Brown/Yellow |
| 20 | Brown/Green |
| 21 | Brown/Blue |
| 22 | Brown/White |
| 23 | Brown/Black |
| 24 | White/Red |
| 25 | White/Orange |
| 26 | White/Yellow |
| 27 | White/Green |
| 28 | White/Blue |
| 29 | White/Gray |
| 30 | White/Black |
| 31 | Blue/Red |
| 32 | Blue/Orange |
| 33 | Blue/Yellow |
| 34 | Blue/Black |

FIG. 7

ULTRA THIN AND FLEXIBLE SCSI CABLE AND METHOD FOR MAKING SAME

CROSS REFERENCE TO RELATED APPLICATIONS

This is a Continuation application of prior application Ser. No. 09/299,688 filed on Apr. 26, 1999 now U.S. Pat. No. 6,124,551.

This application claims priority from U.S. Provisional Patent Application Ser. No. 60/129,455, filed Apr. 15, 1999, and entitled "Ultra Thin and Flexible SCSI Cable and Method for Making the Same." This provisional application is herein incorporated by reference.

BACKGROUND OF THE INVENTION

1. Field of the Invention

This invention relates generally to cables, and more particularly to improved cables used to interconnect computer systems to external peripheral devices.

2. Description of the Related Art

Personal computers provide today's users with the power to communicate with other networked users, share information and access data from peripheral devices. As is well known, personal computers are capable of being connected to a variety of peripheral devices, such as, fixed and removable storage drives, scanners, compact discs, etc. To achieve high performance data transfer interfaces between the host computer system and a given peripheral device, computer users typically use hardware that can take advantage of the small computer system interface (SCSI) protocol. Typically, a computer is provided with SCSI capabilities via SCSI controller cards that connect to the host computer or via a SCSI chip that is integrated as part of the computer's motherboard. Once a computer is provided with SCSI capabilities, the user is able to connect either internal or external SCSI peripheral devices to the computer. Internally, SCSI ribbon cables are used to interconnect the peripheral devices to the computers controller card or a motherboard's connector. Externally, SCSI peripheral devices can be coupled to the computer's connector receptacle via an external SCSI cable.

FIG. 1A illustrates a computer system 10 having a SCSI peripheral device (PD) 12 connected thereto. Generally, a SCSI cable 14 is connected to a SCSI controller connector located on the backside of the computer system's housing. The other end of the SCSI cable 14 has a connector 16 that couples to the SCSI peripheral device 12. Unfortunately, SCSI cables 14 which comport to the rigorous SCSI electrical specification requirements are designed having thick and rigid physical characteristics. For instance, SCSI cable 14 typically has an outer diameter of about ½ inch. Although the SCSI protocol has evolved through several generations to provide enhanced throughput capabilities, the physical makeup of the cabling has remained substantially the same. As a result, the SCSI protocol itself is sometimes viewed by consumers as behind the times, simply because the cabling appears thick, bulky, and is extremely rigid.

FIG. 1B shows a magnified view of the SCSI cable 14 and its internal contents. As shown, the SCSI cable typically has an outer jacket that covers a braided conductive shield 18. The braided conductive shield 18 covers several layers of tightly wrapped plastic and an insulative cover 20. The tightly wrapped plastic and insulative cover 20 is configured to enclose the plurality of wires 22, which lead to the connector 16, which may be a 50 pin or 68 pin connector.

Although there has been a desire to reduce the physical size of the SCSI cable 14, cable designers were largely prevented from completing this task because the SCSI ANSI X3.131 standard for SCSI-1, SCSI-2, and SCSI-3, imposes strict electrical characteristic requirements. In addition, present manufacturing techniques and tooling for conventional SCSI cables are not capable of producing cables with thinner dimensions.

Beyond the fact that conventional SCSI cables 14 place an improper stigma on the SCSI protocol as a whole as being outdated, users of today's computer systems also demand that external cabling be more flexible and capable of spanning longer distances. For instance, users sometimes like to place the housing of the computer system under a desk or at a location that is spaced apart from the computer monitor. At the same time, the user may want to place external peripheral devices, such as, second hard drives, removable drives, scanners, CD ROMs, CD-Rs, CD-RWs, on the desk top near the monitor so as to provide easy access during a working session. Conventional SCSI cables that meet the full SCSI electrical specification are quite short, spanning distances of approximately 2 to 3 feet. The length limitation, coupled with the thick and bulky nature of the SCSI cable, thus reinforces the improper image of SCSI being old and outdated.

Furthermore, because conventional SCSI cables are not very flexible, when a connection is made to the computer housing, the computer housing is sometimes required to be arranged in an awkward way, so as to avoid accidental unplugging. That is, because the conventional SCSI cable resists bending, movement of the computer housing can in some cases cause the connector to be partially unplugged. Consequently, the physical nature of the SCSI cable can introduce a level of unreliability, which can hamper a computer user's image of SCSI and the user's desire to use SCSI for interconnecting to and from external peripheral devices.

In view of the foregoing, there is a need for SCSI cables that have smaller diameters, have improved flexibility, and have the ability of spanning longer distances, while continuing to meet the cabling electrical characteristics set forth in the SCSI standard.

SUMMARY OF THE INVENTION

Broadly speaking, the present invention fills these needs by providing a cable design for use in interconnecting to external SCSI peripheral devices. The cable is designed to be highly flexible and thin, relative to conventional SCSI cables. It should be appreciated that the present invention can be implemented in numerous ways, including as a process of making, an apparatus including the cable, a system for making, or a cable device. Several inventive embodiments of the present invention are described below.

In one embodiment, a SCSI external cable is disclosed. The cable includes: (a) an inner non-conducting fiber; (b) a core layer of twisted pairs, each of the core layer twisted pairs in the core layer being concentrically wrapped around the inner non-conducting fiber; (c) a first layer of twisted pairs, each of the first layer twisted pairs being concentrically wrapped around the core layer of twisted pairs; (d) a second layer of twisted pairs, each of the second layer twisted pairs being concentrically wrapped around the first layer of twisted pairs; (e) an inner shield being concentrically wrapped in a first direction around the second layer of twisted pairs; (f) an outer shield being concentrically wrapped in a second direction around the inner shield, the second direction being opposite the first direction of the inner shield; and (g) a jacket configured to wrap around the outer shield. In this embodiment, a tape separator can optionally be wrapped concentrically around the second layer of twisted pairs, and then, the inner shield can be wrapped around the tape separator. Preferably, the inner shield is an aluminum tape, and the outer shield is in the form of a plurality of flat copper filaments (aligned side-by-side). The plurality of flat copper filaments and the aluminum tape function together to provide the SCSI external cable with an increased degree of flexibility. Most preferably, the cable of this embodiment is capable of being implemented for connectors having up to about 68 pins.

In another embodiment, a SCSI external cable capable of being implemented for connectors having up to about 50 pins is disclosed. The SCSI cable of this embodiment includes: (a) an inner non-conducting fiber; (b) a first layer of twisted pairs, each of the first layer twisted pairs being concentrically wrapped around the inner non-conducting fiber; (c) a second layer of twisted pairs, each of the second layer twisted pairs being concentrically wrapped around the first layer of twisted pairs; (d) an inner shield being concentrically wrapped in a first direction around the second layer of twisted pairs; (e) an outer shield being concentrically wrapped in a second direction around the inner shield, the second direction being opposite the first direction of the inner shield; and (f) a jacket configured to wrap around the outer shield.

In yet another embodiment, a SCSI external cable for interconnecting external peripheral devices to a host computer system or other peripheral devices is disclosed. The SCSI cable includes: (a) an inner non-conducting fiber; (b) a first layer of twisted pairs, each of the first layer twisted pairs being concentrically wrapped around the inner non-conducting fiber; (c) a second layer of twisted pairs, each of the second layer twisted pairs being concentrically wrapped around the first layer of twisted pairs; (d) an inner shield being concentrically wrapped in a first direction around the second layer of twisted pairs, the inner shield being in the form of a tape strip; (e) an outer shield being concentrically wrapped in a second direction around the inner shield, the second direction being opposite the first direction of the inner shield, and the outer shield is in the form of a plurality of flat copper filaments, the plurality of flat copper filaments provide the SCSI external cable an increased degree of flexibility; and (f) a jacket configured to wrap around the outer shield. In this embodiment, it is preferred that each wire in the first layer and the second layer has a respective first layer insulation and a second layer insulation, and the second layer insulation is configured to be thicker than the first layer insulation.

In still another embodiment, a method for making a SCSI external cable is disclosed. The method includes providing a starting non-conductive fiber. Then, the method proceeds to: (a) wrapping a first plurality of twisted pairs in a first concentric orientation around the starting non-conductive fiber; (b) wrapping a second plurality of twisted pairs in a second concentric orientation around the first plurality of wrapped twisted pairs; (c) wrapping an inner shield in the first concentric orientation around the second plurality of wrapped twisted pairs; (d) wrapping an outer shield in the second concentric orientation around the inner shield; and (e) enclosing the starting non-conductive fiber, the first plurality of twisted pairs, the second plurality of twisted pairs; the inner shield; and the outer shield in a cabling jacket.

Although advantages of the embodiments of the SCSI cable of this invention are numerous, the ultra-thin and flexible nature of this design makes the disclosed SCSI cable highly desirable for users demanding longer lengths, higher bandwidth speeds, and flexibility in terms of arranging external SCSI devices in locations that are less proximate to the computer's housing. Furthermore, the ultra-thin and flexible nature of the SCSI cable of the present invention has the power of giving SCSI technology a more modern and current image. Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIGS. 5A through 5C illustrate the electrical characteristics that were achieved by the wires of the SCSI cable under a test environment, in accordance with one embodiment of the present invention.

FIG. 6 illustrates another embodiment of an ultra thin SCSI cable.

FIG. 7 illustrates the exemplary color coding implemented for the embodiment of FIG. 6.

DETAILED DESCRIPTION OF THE PREFERRED EMBODIMENTS

An invention is described for a cable used to interconnect external SCSI peripheral devices to a host computer system. In a preferred embodiment of the present invention, the cable is a highly flexible cable having a substantially reduced diameter, relative to conventional SCSI standard compliant cables. It will be obvious, however, to one skilled in the art, that the present invention may be practiced without some or all of these specific details. In other instances, well known process operations have not been described in detail in order not to unnecessarily obscure the present invention.

Figure 2A:
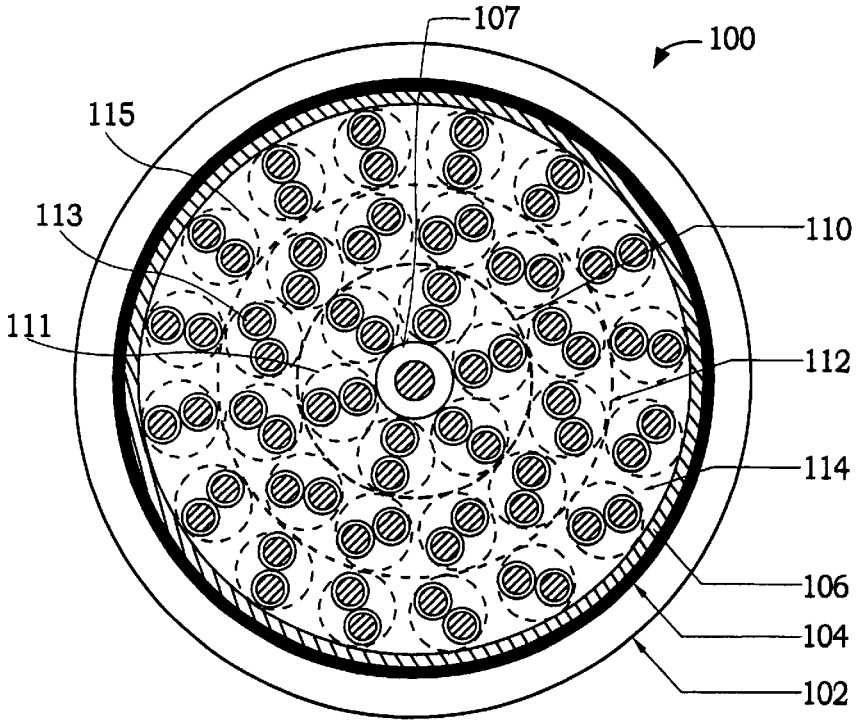
FIG. 2A provides a cross-sectional view of a SCSI cable, in accordance with one embodiment of the present invention.
Figure 2C:
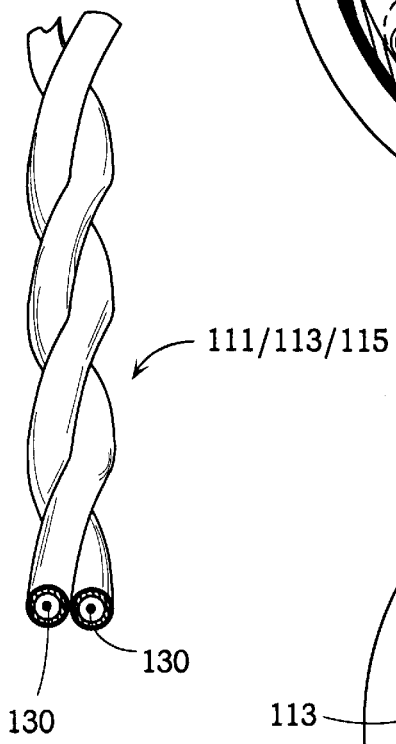
FIGS. 2B and 2C illustrate a SCSI cable that includes a first layer and a second layer of concentrically wrapped twisted pairs, which can be used with 50 pin connectors.

FIG. 2A provides a cross-sectional view of a SCSI cable 100, in accordance with one embodiment of the present invention. The SCSI cable 100 is configured to be a highly flexible and substantially thinner cable that meets the rigid SCSI electrical requirements as dictated by the SCSI standard. In essence, the high performance characteristics provided by conventional thicker and rigid cables in the past can now be provided to users via a very thin cable having a high degree of flexibility. In addition, the design of the SCSI cable 100 is also configured to enable the cable to span a substantially longer distance than conventional SCSI cables, thus providing the user with an increased flexibility in terms of the placement of the computer housing and external peripheral devices.

In one embodiment, the SCSI cable 100 can be designed to span a distance of about 10 meters or more. The outer diameter of the SCSI cable is preferably designed to be about ¼ inch. This outer diameter dimension should be contrasted with a diameter of about ½ inch which is commonly found in conventional rigid SCSI cables. The SCSI cable 100 can be implemented to interconnect to external peripheral devices operating on the proposed Ultra 160/m SCSI standard, which allows transfer rates up to about 160 MB/sec. Of course, the SCSI cable 100 can also be implemented in to carry out data transfers in any of the other well known SCSI compliant levels, such as, SCSI 1, SCSI 2, and the newly created SCSI 3 level.

The SCSI cable 100 will preferably have a flexible PVC jacket 102 that will enclose and protect the shielding layers of the SCSI cable, including the individual wires implemented to complete proper SCSI communication for an exemplary 68-pin connector. A first layer inside of the jacket 102 is an outer shield 104 that is in the form of concentrically wrapped flat copper filaments. The concentrically wrapped flat copper filaments are configured to cover and shield an internal shield 106. The internal shield 106 is preferably an aluminum foil shield that is also concentrically wrapped around the internal wires of the SCSI cable 100. As will be described below, each layer of internal wires of the SCSI cable 100 is also preferably concentrically wrapped about a center fiber.

By way of example, a Kevlar™ fiber 107 is preferably implemented as the center starting fiber of the SCSI cable 100. It should be understood that the Kevlar™ fiber 107 can be interchanged with other materials such as, for example, a high strength, high modulus aramid fiber. For purposes of a preferred exemplary embodiment, the Kevlar™ fiber 107 is used in the fabrication of the SCSI cable 100, which begins by concentrically wrapping twisted pairs of wires 111 around the Kevlar™ fiber 107. For an exemplary SCSI cable supporting a 68 pin connector, there are 6 twisted pairs of wires 111. Each of the individual wires 111 are individually wrapped with a Teflon™ insulation. Although a Teflon™ material available from DuPont is used in an exemplary embodiment, other insulation materials may also be used, such as fluoropolymer-type materials. The conductive wires 130 of each of the twisted pairs 111, 113, and 115, are preferably silver-plated copper wires. Each wire is, in this preferred embodiment, a 34-gauge wire.

The twisted pairs 111 will therefore define a core layer 110 of twisted pairs that wrap around the Kevlar™ fiber 107. Once the core layer 110 is complete, a first layer of twisted pairs 113 is concentrically wrapped around the core layer of twisted pairs 111. After the first layer 112 of twisted pairs is concentrically wrapped, a second layer of twisted pairs 115 is concentrically wrapped around the first layer 112 of twisted pairs 113. When the core layer 110, the first layer 112, and the second layer 114 have been consecutively wrapped in a concentric manner about the Kevlar™ fiber 107, the inner shield 106 is concentrically wrapped to initially hold the layers of twisted pairs together. At this point, the outer shield 104 is concentrically wrapped around the inner shield 106 to provide a proper electrical shielding of the plurality of wires that are provided as twisted pairs in the various layers.

Figure 2B:
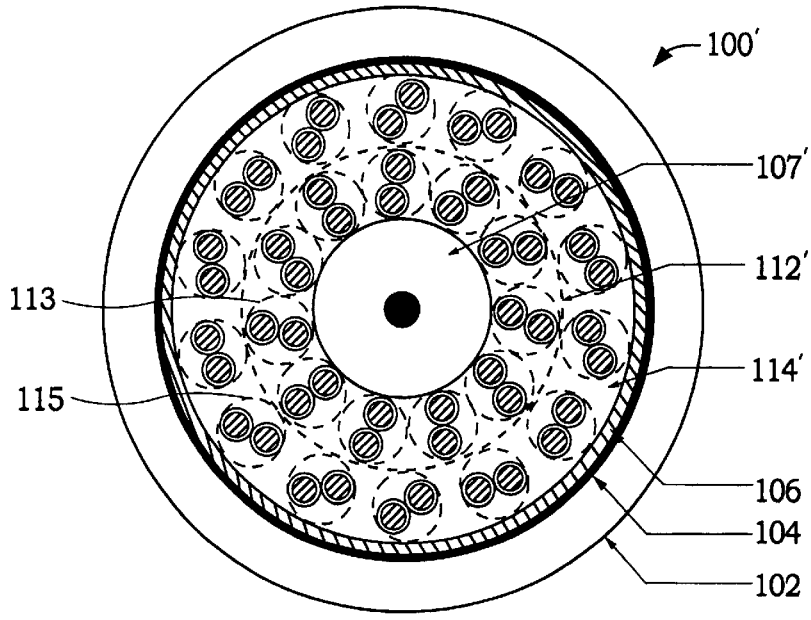

FIG. 2B illustrates a SCSI cable 100' that includes a first layer 112' and a second layer 114' of concentrically wrapped twisted pairs 113 and 115, respectively. In this embodiment, the SCSI cable 110' is preferably suited to interconnect to a 50-pin SCSI connector. As such, the Kevlar™ fiber 107' may be designed to have a larger diameter. Once the twisted pairs 113 are concentrically wrapped about the Kevlar™ fiber 107', the twisted pairs 115 that make up the second layer will be concentrically wrapped about the first layer 112' of twisted pairs. As in the embodiment of FIG. 2A, an inner shield 106 concentrically wraps around the twisted pairs of the second layer 114' and an outer shield 104 wraps around the inner shield 106. Once the inner shield 106 and outer shield 104 have been concentrically wrapped to achieve a proper tight fit, the PVC jacket 102 is applied around the outer shield 104, thus defining the SCSI cable 100'. In this embodiment, the first layer 112' will have 11 pairs 113 and the second layer 114' will have 14 pairs, thus providing 50 individual wires to connect up to a 50 pin connector.

Figure 3A:
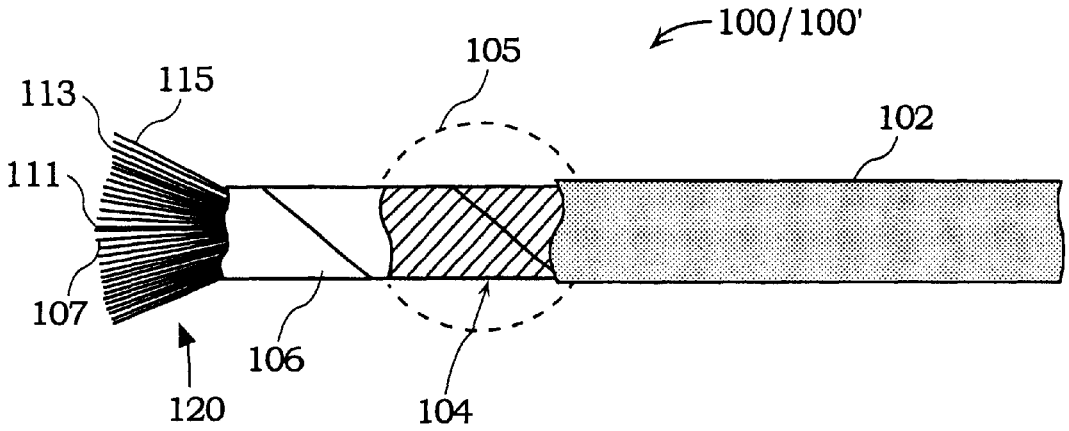
FIGS. 3A and 3B show side views of the SCSI cable, in accordance with one embodiment of the present invention.
Figure 3B:
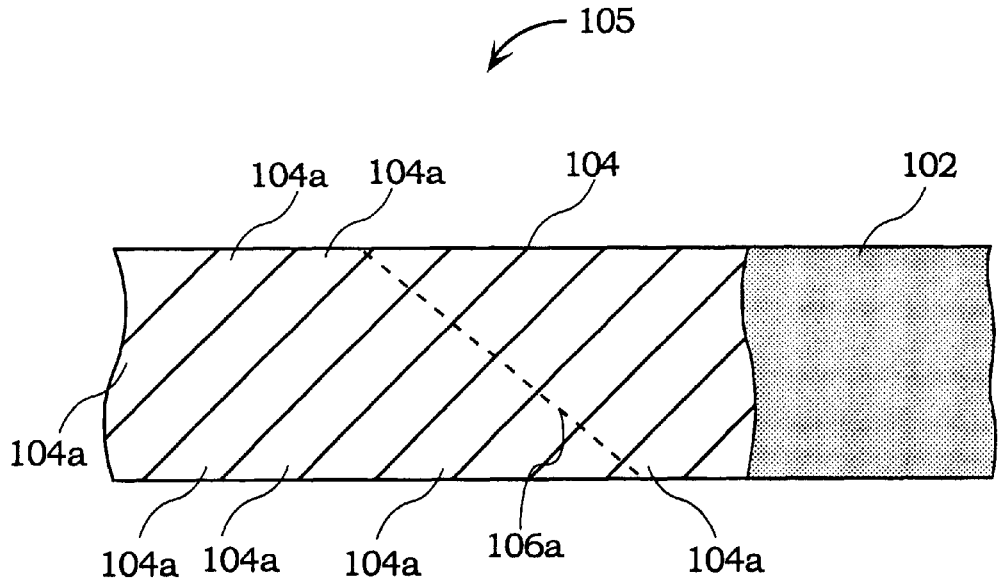

FIG. 3A shows a side view of the SCSI cable 100/100' in accordance with one embodiment of the present invention. From this perspective, the jacket 102 of the SCSI cable 100 is peeled back in order to expose the internal layers described with reference to the cross-sectional views of FIGS. 2A and 2B above. As shown, the plurality of concentrically wrapped wire pairs 111, 113, and 115 are contained with the inner shield 106. The inner shield 106, as described above, is preferably an aluminum foil shield that concentrically wraps around the plurality of wires 120. In a more preferred embodiment, the aluminum foil has an underside side (designed to be in contact with the wires 120) that has a polyester tape texture and an outer side (designed to be in contact with the outer shield 104) having an aluminum texture. To ensure that a SCSI compliant shield is provided for the plurality of wires 120, the inner shield 106 is preferably wrapped with an overlap that ranges between about 1 percent and about 35 percent, and most preferably about 25 percent. The outer shield 104 is shown concentrically wrapped in an opposite direction of the inner shield 106. FIG. 3B provides a magnified view 105 of the outer shield 104. As shown, the outer shield 104 has a plurality of concentrically wrapped flat copper filaments 104*a*.

Figure 1A:
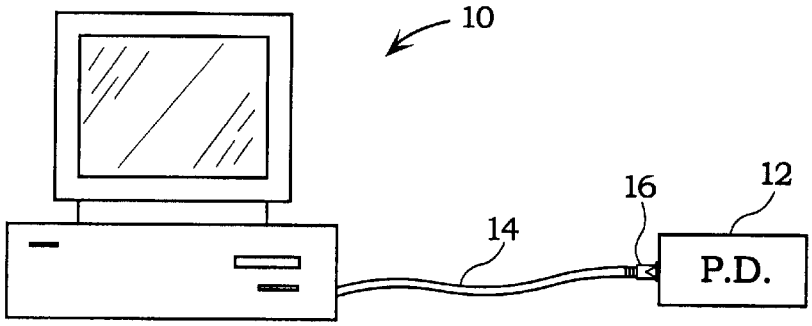
FIG. 1A (Prior art)
FIG. 1A illustrates a computer system having a SCSI peripheral device (PD) connected thereto, in accordance with the prior art.
Figure 1B:
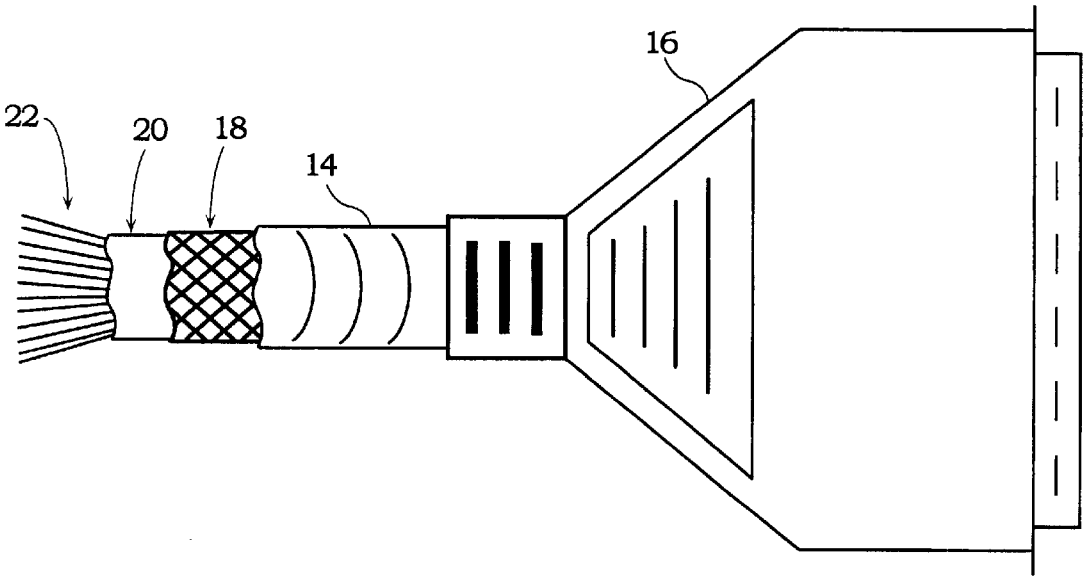
FIG. 1B (Prior art)
FIG. 1B shows a magnified view of the SCSI cable of FIG. 1A and its internal contents.

The concentrically wrapped flat copper filaments 104*a* will therefore provide a coverage that is at least about 94 percent of the inner shield 106. The concentric wrapping of the flat copper filaments 104*a* will therefore provide an increased flexibility to the SCSI cable 100/100'. This should be contrasted with conventional SCSI cables that implement a tightly braided shield, such as braided shield 18 of FIG. 1B. Braided shields are wrapped in both directions which impede a cable's ability to flex in a desired direction and then maintain the desired bend. Furthermore, the concentrically wrapped orientation of the inner shield 106 also provides an additional level of flexibility to the SCSI cable 100/100'. In a preferred exemplary embodiment, the finished outer diameter of the SCSI cable 100 can be as small as about 0.248 inch, and the SCSI cable 100' can be as small as about 0.241 inch. Of course, these diameter dimensions are only exemplary, and they may be decreased or increased depending upon the application. If, however, the diameter is decreased too much, the flexibility of the cable may decrease slightly.

Figure 4A:
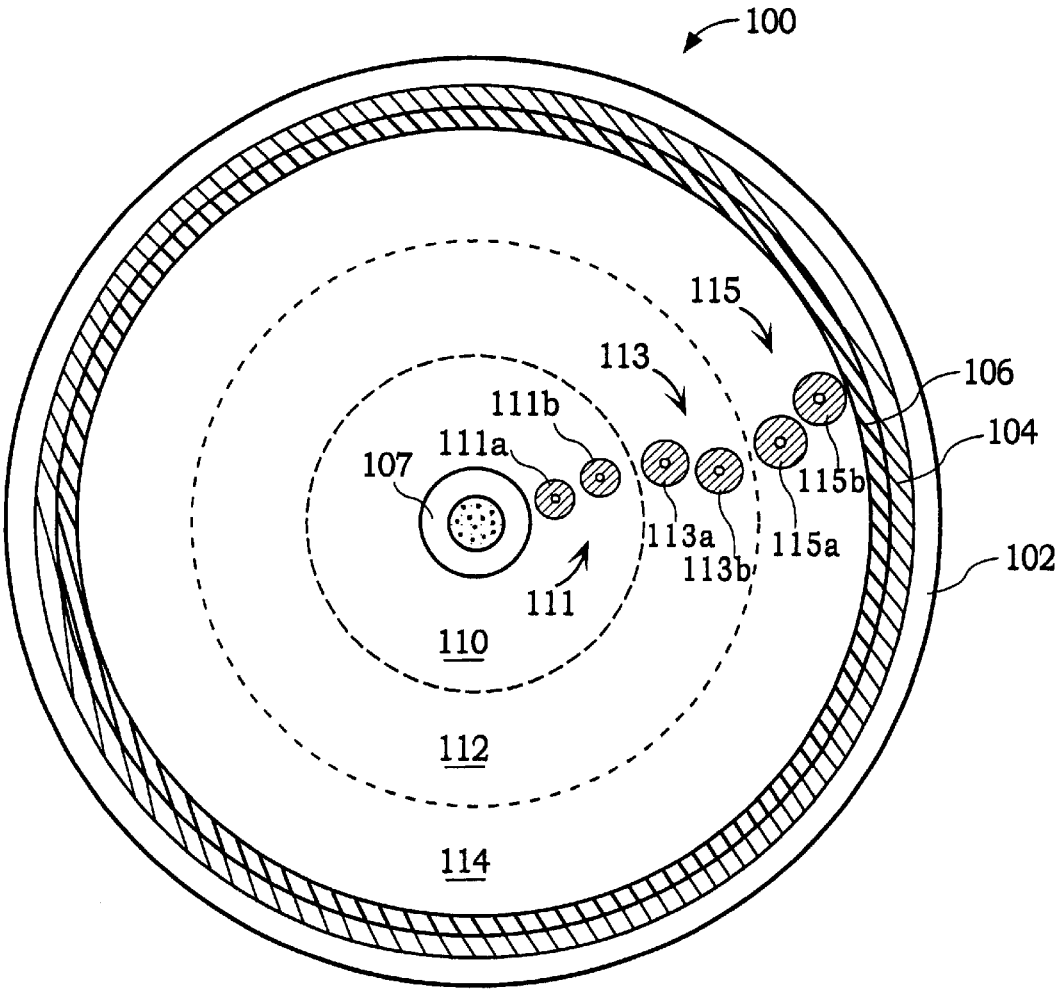
FIG. 4A illustrates another cross-sectional view of a SCSI cable in accordance with one embodiment of the present invention.
Figure 4B:
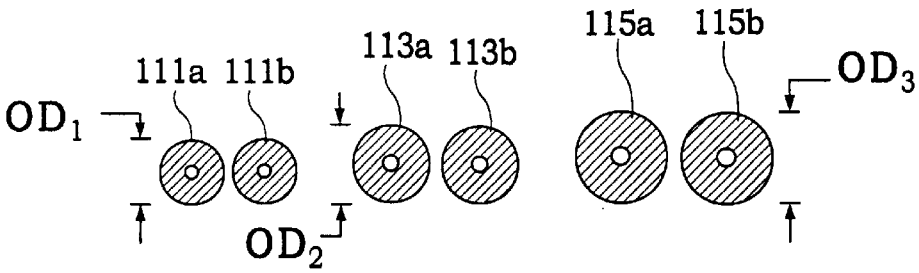
FIG. 4B provides a magnified view of the varying insulation thicknesses used in accordance with one embodiment of the present invention.

FIG. 4A illustrates another cross-sectional view of the SCSI cable 100 in accordance with one embodiment of the present invention. From this cross-sectional view, the twisted pairs 111, 113, and 115 that lie in the core layer 110, the first layer 112, and the second layer 114, are configured to have varying thicknesses of Teflon™ insulation. As shown in FIG. 4B, the Teflon™ insulation of the twisted pairs preferably increases as the wires are arranged closer to the shields 104 and 106 of the SCSI cable 100. For instance, the outer diameter $OD_1$ of the twisted pairs 111, that include wires 111*a* and 111*b,* is preferably about 0.034 inch. The $OD_2$ of the twisted pairs 113, that include wires 113*a* and 113*b,* is preferably about 0.034 inch. The $OD_3$ of the twisted pairs 115, that include wires 115*a* and 115*b,* is preferably about 0.041 inch. It should be understood that these outer diameter dimensions are only exemplary, and are configured to provide the SCSI cable 100 with the required electrical characteristics defined by the SCSI specification.

FIGS. 5A through 5C illustrate preliminary electrical characteristics that were achieved by the wires of the SCSI cable 100 under a testing environment, in accordance with one embodiment of the present invention. Testing was carried-out for single end and differential impedance, single end and differential capacitance and propagation delay. For a 34 pair SCSI cable, the wire pairs of each layer were tested for each of these characteristics. Accordingly, FIG. 5A illustrates the impedance ($Z_0$) in ohms and the capacitance in pF/ft for both the differential test and the single ended test. Also provided is the obtained propagation delay in nanoseconds/feet (ns/ft). FIGS. 5B and 5C provide the same information for each of the respective first layer 112 and second layer 114.

For the differential case, the average impedance was calculated to be about 146.9 ohms, and the average capacitance was calculated to about 10.2. For the single ended case, the average impedance was calculated to be about 91, and the average capacitance was calculated to be about 16.5. The average propagation delay was calculated to be about 1.5 ns/ft. These tested electrical characteristics illustrate that the SCSI cable 100/100' of the present invention can meet the requirements set forth by the SCSI specification. In an actual production design, the impedance can be adjusted to fit exactly within the SCSI specification ranges. For instance, the impedance for a differential embodiment can range between about 110 and 135 ohms, and for a single ended embodiment the impedance can range between about 72 and 96 ohms. For more information on the requirements set by the SCSI specification, reference may be made to The ANSI SPI-3 Specification (working draft), Rev. 4 (1999), which is incorporated herein by reference.

Table A below identifies the wires, associated pins and color coding implemented for a single ended (SE) implementation of 68 pin connector in accordance with one embodiment of the present invention. As shown, the table provides a cable conductor number, the color coding of each wire, the signal name, the twisted pair numbers, and the layer in which each twisted pair lies. In Table A, the minus sign next to a signal indicates active low.

TABLE A

| Signal Name | Cable Conductor Number | | Color Coding | Signal Name | Twisted Pair # | Layer |
|---|---|---|---|---|---|---|
| SIGNAL RETURN | 1 | 2 | Green/ Brown | -DB(12) | 1 | 2nd |
| SIGNAL RETURN | 3 | 4 | Green/ Blue | -DB(13) | 2 | 2nd |

TABLE A-continued

| Signal Name | Cable Conductor Number | | Color Coding | Signal Name | Twisted Pair # | Layer |
|---|---|---|---|---|---|---|
| SIGNAL RETURN | 5 | 6 | Green/ Red | -DB(14) | 3 | 2nd |
| SIGNAL RETURN | 7 | 8 | Green/ Black | -DB(15) | 4 | 2nd |
| SIGNAL RETURN | 9 | 10 | White/ Gray | -DB(P1) | 5 | 2nd |
| SIGNAL RETURN | 11 | 12 | White/ Yellow | -DB(0) | 6 | 2nd |
| SIGNAL RETURN | 13 | 14 | White/ Orange | -DB(1) | 7 | 2nd |
| SIGNAL RETURN | 15 | 16 | White/ Brown | -DB(2) | 8 | 2nd |
| SIGNAL RETURN | 17 | 18 | White/ Red | -DB(3) | 9 | 2nd |
| SIGNAL RETURN | 19 | 20 | White/ Black | -DB(4) | 10 | 2nd |
| SIGNAL RETURN | 21 | 22 | While/ Green | -DB(5) | 11 | 2nd |
| SIGNAL RETURN | 23 | 24 | Gray/ Yellow | -DB(6) | 12 | 2nd |
| SIGNAL RETURN | 25 | 26 | Gray/ Orange | -DB(7) | 13 | 2nd |
| SIGNAL RETURN | 27 | 28 | Gray/ Brown | -DB(8) | 14 | 2nd |
| GROUND | 29 | 30 | Gray/ Red | GROUND | 15 | 2nd |
| GROUND | 31 | 32 | Gray/ Black | GROUND | 16 | 2nd |
| TERM-PWR | 33 | 34 | Gray/ Green | termpwr | 17 | 1st |
| TERM-PWR | 35 | 36 | Yellow/ Orange | termpwr | 18 | 1st |
| RESERV-ED | 37 | 38 | Yellow/ Brown | reserved | 19 | 1st |
| GROUND | 39 | 40 | Yellow Red | GROUND | 20 | 1st |
| SIGNAL RETURN | 41 | 42 | Yellow/ Black | -ATN | 21 | 1st |
| GROUND | 43 | 44 | Yellow/ Green | GROUND | 22 | 1st |
| SIGNAL RETURN | 45 | 46 | Yellow/ Blue | -BSY | 23 | 1st |
| SIGNAL RETURN | 47 | 48 | Orange/ Brown | -ACK | 24 | core |
| SIGNAL RETURN | 49 | 50 | Orange/ Red | -RST | 25 | core |
| SIGNAL RETURN | 51 | 52 | Orange/ Black | -MSG | 26 | core |
| SIGNAL RETURN | 53 | 54 | Orange/ Green | -SEL | 27 | core |
| SIGNAL RETURN | 55 | 56 | Orange/ Blue | -C/D | 28 | core |
| SIGNAL RETURN | 57 | 58 | Brown/ Red | -REQ | 29 | core |
| SIGNAL RETURN | 59 | 60 | Brown/ Black | -I/O | 30 | 1st |
| SIGNAL RETURN | 61 | 62 | Brown/ Green | -DB(8) | 31 | 1st |
| SIGNAL RETURN | 63 | 64 | Brown/ Blue | -DB(9) | 32 | 1st |
| SIGNAL RETURN | 65 | 66 | Red/ Black | -DB(10) | 33 | 1st |
| SIGNAL RETURN | 67 | 68 | Red/ Blue | -DB(11) | 34 | 1st |

FIG. 6 illustrates another embodiment of the present invention. In this embodiment, an FEP (Fluorinated Ethylene Polymer) Filler surrounding a Kevlar™ strength member 107" defines the inner most structure of the SCSI cable 100". A core layer 110 of twisted pairs 111' are wrapped concentrically around the member 107". A first layer 112 of twisted pairs 113' are then wrapped concentrically around the twisted pairs 111'. A second layer 114 of twisted pairs 115' are then concentrically wrapped around the twisted pairs 113'. In this embodiment, a separator 103 is wrapped around the second layer 114 of twisted pairs 115'. Preferably, the separator 103 is in the form of a foamed polypropylene tape, which is wrapped with about 40% overlap. By implementing the separator 103, it is possible to use the same thickness insulator for all of the wires of the internal twisted pairs, while still adhering to the SCSI requirements. An inner shield 106, which is preferably an aluminum tape, is then concentrically wrapped around the separator 103. At this point, the outer shield 104 can be concentrically wrapped around the inner shield 106.

A jacket 102, which is preferably a super flexible PCV (e.g., having a wall thickness of about 0.023"), is wrapped around the outer shield 104. The finished outer diameter, in this embodiment, can be made to be about 0.230" OD.

FIG. 7 illustrates the exemplary color coding implemented for the embodiment of FIG. 6. As shown, the core layer 110 has 5 twisted pairs, the first layer has 11 twisted pairs, and the second layer has 18 twisted pairs. Each of the preferred color combinations are provided with specific reference to the pair number, in this example of a 68 wire SCSI cable. Of course, this embodiment may also be practiced for 50 wire SCSI cables, or any other cable embodiments having varying number of wires.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A SCSI external cable, comprising:

an inner non-conducting fiber;

a core layer of twisted pairs, each of the core layer twisted pairs in the core layer being concentrically wrapped around the inner non-conducting fiber;

a first layer of twisted pairs, each of the first layer twisted pairs being concentrically wrapped around the core layer of twisted pairs;

a second layer of twisted pairs, each of the second layer twisted pairs being concentrically wrapped around the first layer of twisted pairs;

an inner shield being concentrically wrapped in a first direction around the second layer of twisted pairs;

an outer shield being concentrically wrapped in a second direction around the inner shield, the second direction being opposite the first direction of the inner shield and the outer shield is divided into a plurality of flat copper filaments, the plurality of flat copper filaments provide the SCSI external cable an increased degree of flexibility; and a jacket configured to wrap around the outer shield.

2. A SCSI external cable as recited in claim 1, wherein the inner shield is an aluminum tape, the aluminum tape has a plastic internal side that is in contact with the second layer of twisted pairs.

3. A SCSI external cable as recited in claim 1, wherein the core layer of twisted pairs includes six twisted pairs.

4. A SCSI external cable as recited in claim 1, wherein the first layer of twisted pairs includes twelve twisted pairs.

5. A SCSI external cable as recited in claim 1, wherein the second layer of twisted pairs includes sixteen twisted pairs.

6. A SCSI external cable as recited in claim 1, wherein each of the core layer twisted pairs, the first layer twisted pairs and the second layer twisted pairs are color coded.

7. A SCSI external cable as recited in claim 1, wherein the SCSI cable has a length of up to about 10 meters and has a data transfer rate of up to about 160 MB/sec.

8. A SCSI external cable as recited in claim 1, wherein each wire of the core layer twisted pairs, the first layer twisted pairs and the second layer twisted pairs is a 34 gauge silver plated copper wire.

9. A SCSI external cable as recited in claim 8, wherein the SCSI cable has a differential cabled impedance ranging between about 110 and 160 ohms and a single end cabled impedance ranging between about 72 and 96 ohms.

10. A SCSI external cable as recited in claim 9, wherein the jacket of the SCSI cable has an outer diameter of about ¼ inch.

11. A SCSI external cable as recited in claim 8, wherein the SCSI cable has a differential cabled capacitance of about 10±0.2 pF/ft and a single end cabled capacitance of about 16.5±0.5 pF.

12. A SCSI external cable as recited in claim 8, wherein the SCSI cable has a cabled propagation delay of about 1.5±0.1 ns/ft.

13. A SCSI external cable as recited in claim 1, further including a separator layer, being concentrically wrapped around the second layer of twisted pairs and contained within the inner shield.

14. A SCSI external cable, comprising:

an inner non-conducting fiber;

a first layer of twisted pairs, each of the first layer twisted pairs being concentrically wrapped around the inner non-conducting fiber;

a second layer of twisted pairs, each of the second layer twisted pairs being concentrically wrapped around the first layer of twisted pairs;

an inner shield being concentrically wrapped in a first direction around the second layer of twisted pairs;

an outer shield being concentrically wrapped in a second direction around the inner shield, the second direction being opposite the first direction of the inner shield, wherein the outer shield is divided into a plurality of flat copper filaments, the plurality of flat copper filaments provide the SCSI external cable an increased degree of flexibility; and a jacket configured to wrap around the outer shield.

15. A SCSI external cable as recited in claim 14, wherein the inner shield is an aluminum tape, the aluminum tape has a plastic internal side that is in contact with the second layer of twisted pairs.

16. A SCSI external cable as recited in claim 14, wherein the first layer of twisted pairs includes eleven twisted pairs.

17. A SCSI external cable as recited in claim 14, wherein the second layer of twisted pairs includes fourteen twisted pairs.

18. A SCSI external cable as recited in claim 14, wherein each of the first layer twisted pairs and the second layer twisted pairs are color coded.

19. A SCSI external cable as recited in claim 14, wherein the SCSI cable can span a length of up to about 10 meters and have a data transfer rate of about 160 MB/sec.

20. A SCSI external cable for interconnecting external peripheral devices to a host computer system or other peripheral devices, comprising:

an inner non-conducting fiber;

a first layer of twisted pairs, each of the first layer twisted pairs being concentrically wrapped around the inner non-conducting fiber;

a second layer of twisted pairs, each of the second layer twisted pairs being concentrically wrapped around the first layer of twisted pairs;

an inner shield being concentrically wrapped in a first direction around the second layer of twisted pairs, the inner shield being in the form of a tape strip having a polyester tape texture that is in contact with the second layer of twisted pairs;

an outer shield being concentrically wrapped in a second direction around the inner shield, the second direction being opposite the first direction of the inner shield, and the outer shield is in the form of a plurality of flat copper filaments, the plurality of flat copper filaments provide the SCSI external cable an increased degree of flexibility; and a jacket configured to wrap around the outer shield.

21. A SCSI external cable for interconnecting external peripheral devices to a host computer system or other peripheral devices as recited in claim 20, further comprising:

a separator that is configured to be concentrically wrapped around the second layer of twisted pairs and contained within inner shield.

22. A method for making a SCSI external cable, comprising:

providing a starting non-conductive fiber;

wrapping a first plurality of twisted pairs in a first concentric orientation around the starting non-conductive fiber;

wrapping a second plurality of twisted pairs in a second concentric orientation around the first plurality of wrapped twisted pairs;

wrapping an inner shield in the first concentric orientation around the second plurality of wrapped twisted pairs;

wrapping an outer shield in the second concentric orientation around the inner shield wherein the outer shield is in the form of a plurality of flat copper filaments; and enclosing the starting non-conductive fiber, the first plurality of twisted pairs, the second plurality of twisted pairs; the inner shield; and the outer shield in a cabling jacket.

23. A method for making a SCSI external cable as recited in claim 22, wherein the first concentric orientation is opposite the second concentric orientation.

24. A method for making a SCSI external cable as recited in claim 22, wherein the inner shield is an aluminum tape.

25. A method for making a SCSI external cable as recited in claim 22, wherein the SCSI external cable has a length of up to about 10 meters and has a data transfer rate of up to about 160 MB/sec.

26. A method for making a SCSI external cable as recited in claim 22, wherein each wire of the first and second plurality of twisted pairs is a 34 gauge silver plated copper wire.

27. A method for making a SCSI external cable as recited in claim 22, further comprising:

wrapping a separator around the second plurality of twisted pairs, and the separator is contained within the inner shield.

* * * * *